United States Patent [19]

Agbay

[11] Patent Number: 4,635,452

[45] Date of Patent: Jan. 13, 1987

[54] DOUBLE-ACTING BARREL LOCK AND KEY

[75] Inventor: Anthony J. Agbay, Auburn, Mass.

[73] Assignee: Olson Manufacturing Company, Holden, Mass.

[21] Appl. No.: 820,224

[22] Filed: Jan. 21, 1986

[51] Int. Cl.[4] ..... E05B 67/36

[52] U.S. Cl. ..... 70/34; 70/386; 70/397

[58] Field of Search ..... 70/34, 386, 395, 397, 70/398, 32, 33

[56] References Cited

U.S. PATENT DOCUMENTS

| | | | |
|---|---|---|---|
| 3,835,674 | 9/1974 | Hoyt | 70/34 |
| 4,040,279 | 8/1977 | Signorelli | 70/34 |
| 4,058,992 | 11/1977 | Nielsen | 70/386 |
| 4,155,232 | 5/1979 | Hans | 70/34 |
| 4,313,319 | 2/1982 | Hans | 70/34 |
| 4,441,343 | 4/1984 | Nielsen | 70/386 |
| 4,519,225 | 5/1985 | Simmler | 70/34 |

*Primary Examiner*—Henry E. Raduazo

*Attorney, Agent, or Firm*—Thompson, Birch, Gauthier & Samuels

[57] ABSTRACT

A double-acting barrel lock and key in which the lock has a hollow plunger which reciprocates between a security forward locking position and a normal rearward unlocking position. The lock also has a lock pin coaxially mounted within the hollow plunger for reciprocating between a forward unlocking position and a normal rearward locking position. When a nail-type pick is inserted into the rear of the lock and drives the lock pin forwardly to its unlocking position, a spring urges the hollow plunger forwardly to its security locking position in which the locking balls are maintained in their outward locking position.

A key has double-acting means for simultaneously maintaining the hollow lock plunger in its normal rearward unlocking position while moving the lock pin to its forward unlocking position, thereby permitting the locking balls to move inwardly to their unlocking position.

9 Claims, 9 Drawing Figures

DOUBLE-ACTING BARREL LOCK AND KEY

BACKGROUND OF THE INVENTION

Conventional barrel locks and keys become obsolete when thieves learn how to pick the locks, or when authorized keys fall into a large number of unauthorized hands. Therefore, new lock and key arrangements must be designed to maximize the security of equipment adapted to be secured by barrel locks.

The closest prior art of which applicant is aware includes the following patents:

| | |
|---|---|
| Morse et al. | U.S. Pat. No. 3,714,802 |
| Hoyt | U.S. Pat. No. 3,835,674 |
| Moberg | U.S. Pat. No. 4,015,456 |

SUMMARY OF THIS INVENTION

This invention involves improvements to the interior mechanisms of conventional barrel locks and keys. The improved lock includes a hollow plunger which is spring-loaded rearwardly to its unlocking position. A lock pin is spring loaded rearwardly to its locking position. The hollow plunger has a forwardly located large diameter camming surface which is of approximately the same diameter as the forwardly located camming surface of the lock pin. By this arrangement, when a nail-type pick is inserted through the rear aperture of the lock, the forward movement of the lock pin to its unlocking position (in which the lock pin camming surface is moved clear of the locking balls) is accompanied by the correspondingly forward movement of the hollow plunger to its security locking position in which its large diameter camming portion maintains the locking balls in their outward locking position. By this means, the use of a nail-type pick fails to open the lock.

A double-acting key is provided to open the lock. The key has a push rod coaxially mounted within an expanding sleeve. The push rod and expanding sleeve are sized and shaped so as to permit their insertion through the rear aperture of the lock barrel. The actuation of the key provides a double action in which the expanding sleeve engages and fixes the lock plunger in rearward unlocking position while simultaneously pushing the lock pin to its forward unlocking position, thereby permitting the locking balls to move inwardly to their unlocking position. The lock can then be withdrawn from the support aperture.

Furthermore, a preload rod is provided which has means at its forward end for wedgingly engaging the lock pin and the plunger to hold them in their unlocking positions. By use of the preload rod, an installer can insert the unlocked lock through the support aperture and then withdraw the preload rod from the lock in order to lock the lock without the use of a key.

DESCRIPTION OF THE PREFERRED EMBODIMENT OF THIS INVENTION

Figure 1:
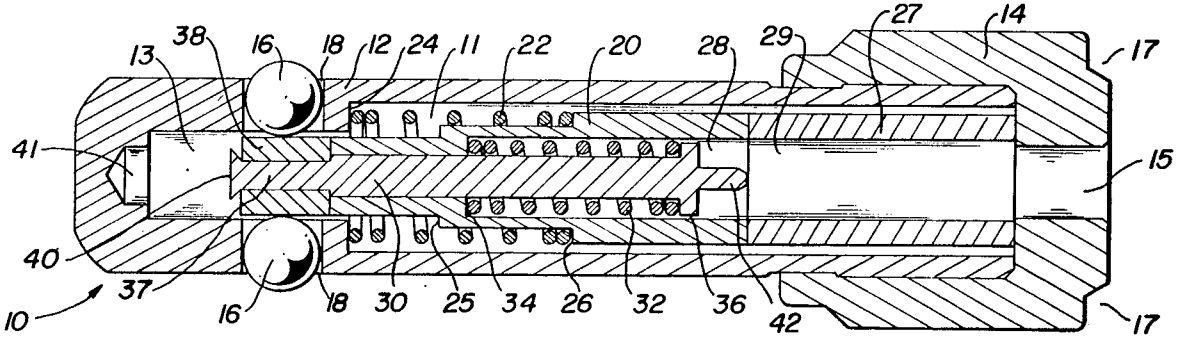
FIG. 1 is a section of the lock of this invention.
Figure 7:
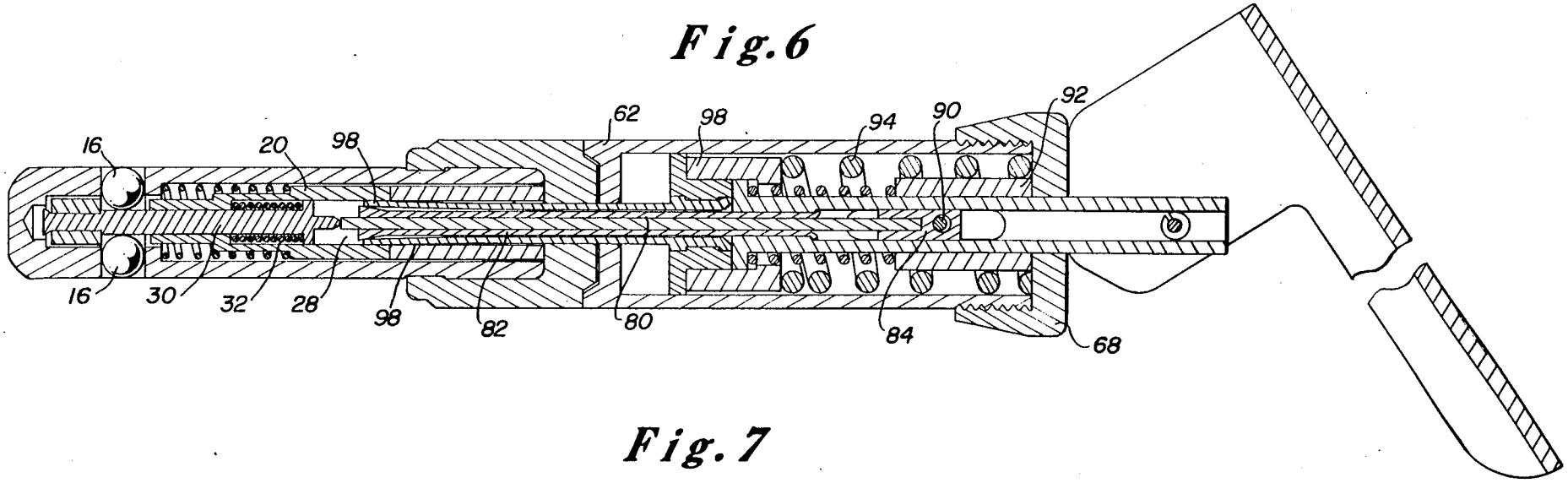
FIG. 7 shows the key inserted into the lock after the unlocking of the lock.

Referring to FIG. 1, there is depicted in cross-section the lock 10 of the instant invention. Tubular barrel 12 having outer cylindrical axial bore 11 and inner bore 13 is substantially closed at one end by head or cap 14. Cap 14 includes axial bore 15 which forms the keyhold of the lock, as further described below. Cap 14 also includes a tapered end portion 17 which mates with recess 108 of barrel 62 of key 60 as explained below (FIG. 7).

Balls 16 are movably retained in a diametrical bore 18 in body 12 in conventional fashion. Tubular plunger 20 is slidably mounted within bores 11 and 13 of barrel 12 and is pressed toward cap 14 by spring 22 which at one end engages internal annular shoulder 24 of barrel 12, and at the other engages external annular shoulder 26 of plunger 20. Lock pin 30 is slidably mounted within cylindrical axial bore 28 of plunger 20, and is pushed toward end cap 14 by inner spring 32, which engages internal annular shoulder 34 of plunger 20, and cylindrical head 36 of locking pin 30. Tubular spacer 27 abuts plunger 20 at one end and end cap 14 at the other, and includes axial cylindrical bore 29 of the same diameter as bore 28 of plunger 20.

Figure 3:
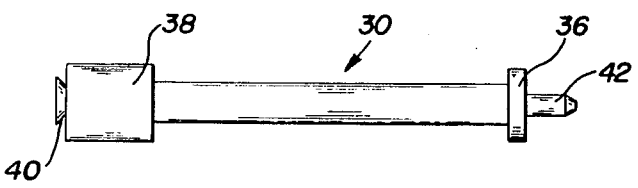
FIG. 3 is an elevation of the lock pin shown in FIG. 1.

Cylindrical head 36 of lock pin 30 is of slightly less diameter than bore 28 of plunger 20. Protrusion 42 extends axially from head 36, and is beveled at its end. The shank of pin 30 is terminated at its innermost end by a portion of reduced diameter 37 and a flared end 40. Pin sleeve 38 is mounted on said reduced diameter portion 37 and is held in place by flared end 40, said pin sleeve being of outer diameter equal to the diameter of plunger 20 at its inner end 50. See FIG. 3. Inner bore 13 of barrel 12 is terminated in a partly conical end bore 41 which, as seen in FIG. 7 below, may receive the flared end 40 of locking pin 30 when lock 10 is unlocked.

In FIG. 1, plunger 20 is depicted in its normal rearward unlocking position, spring 22 holding plunger 20 against the forward end of spacer 27, the other end of spacer 27 abutting end cap 14. Lock pin 30 is depicted in its normal rearward locking position, the outer (camming) surface of pin sleeve 38 engaging balls 16, and holding said balls in extended position in a radial direction. In such position, balls 16 may be received in an annular groove of a cover member (not shown) in conventional fashion. See, e.g., Hoyt U.S. Pat. No. 3,835,674.

Figure 2:
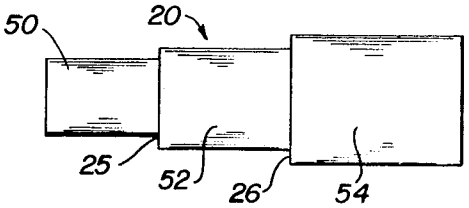
FIG. 2 is an elevation of the lock plunger shown in FIG. 1.

Plunger 20 is depicted in FIG. 2, and comprises three portions: a first portion 54 at the outer end and having a diameter slightly less than that of bore 11 of barrel 12; a second portion 52 having a diameter slightly more than the diameter of inner bore 13 of barrel 12; and a third portion 50 having a diameter slightly less than that of inner bore 13. Shoulder 25 limits the inward movement of plunger 20 by engaging internal annular shoulder 24 of barrel 12. (See FIG. 8).

Figure 4:
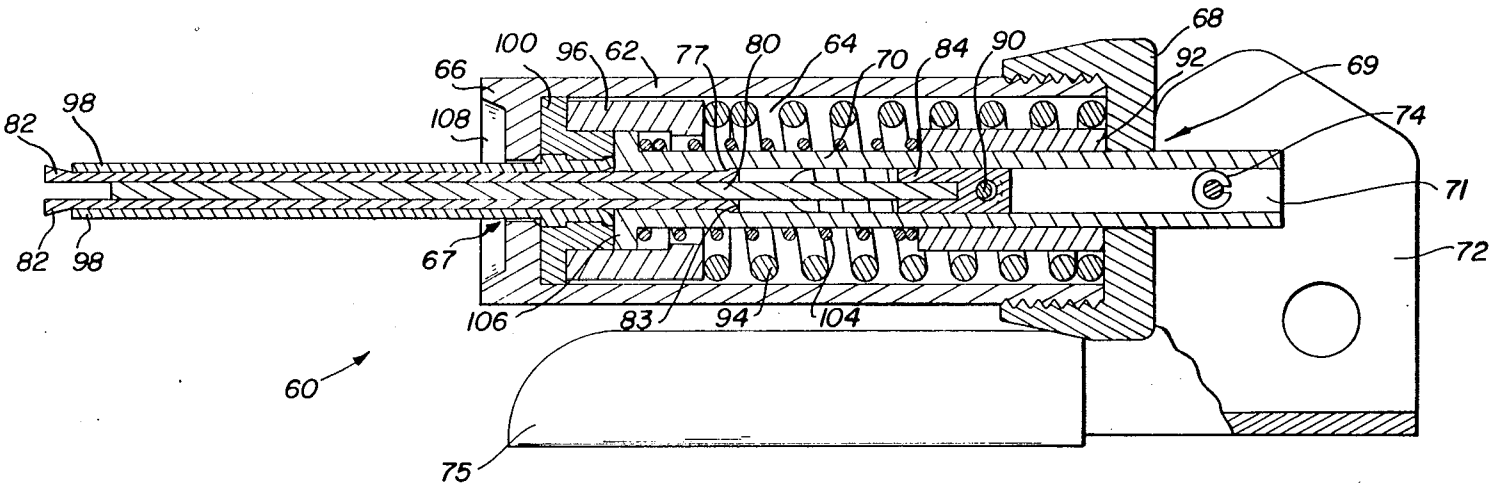
FIG. 4 is a section of the key of this invention.
Figure 5:
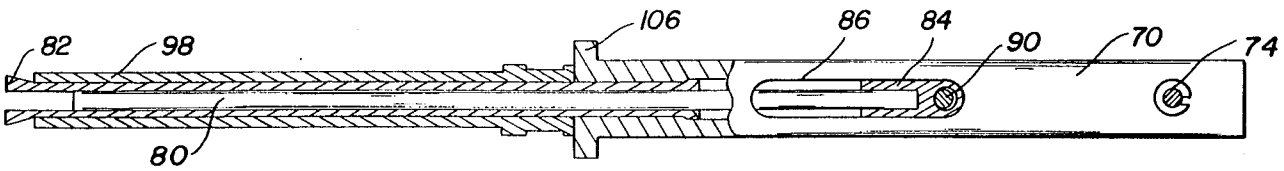
FIG. 5 is an elevation of several of the cooperating parts of the key shown in FIG. 4.

Turning to FIG. 4, the construction of the key of the instant invention will now be described. Key 60 comprises tubular body 62 having a cylindrical axial bore 64 extending for most of its length, and a wall 66 at one end having a cylindrical axial bore 67 therethrough. The other end of body 62 is substantially closed by threaded end cap 68, which has a cylindrical axial bore 69 through which key plunger 70 extends. Plunger 70 is connected to cam handle 72 by spring and pin 74, cam handle 72 being pivotable about spring and pin 74 as more fully explained below. Grip 75 is attached to cam handle 72 to ensure a secure grip on the key during its operation.

Key plunger 70 comprises a tubular member having an inner bore 71, within which push rod 80 is slidably mounted. Expander pin 82 surrounds push rod 80 along most of its length, and includes annular shoulder 83 at its inner end which engages internal annular shoulder 77 of plunger 70. The inner end of rod 80 is held in axial position within plunger 70 by busning 84. A pair of elongated slots 86 (FIG. 4) on opposite sides of plunger 70 permit a pin 90 to pass through bushing 84 to affix bushing 84 to cylindrical sleeve 92 which surrounds the plunger at end cap 68.

Outer spring 94 engages spacer 96 at one end, and engages end cap 68 at the other to normally push spacer 96 away from end cap 68. Expanding sleeve 98 is connected to bushing 100 so that these two elements move as a unit. Inner spring 104 engages the inner side of a cylindrical head 106 formed on plunger 70, and at the other end engages sleeve 92.

Figure 6:
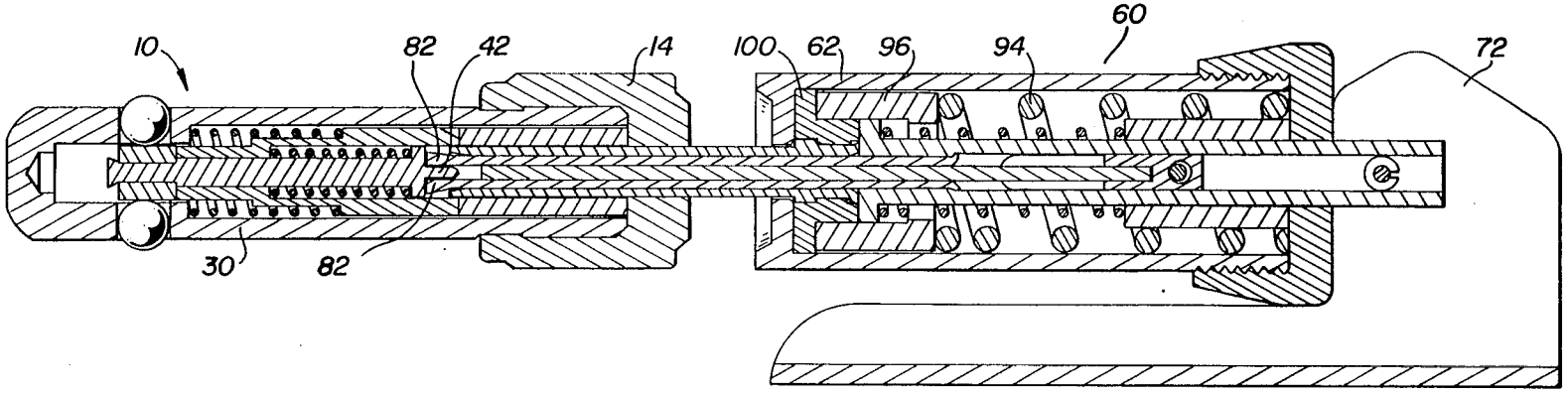
FIG. 6 is a section showing the key inserted into the lock prior to the unlocking of the lock.

The interaction of key 60 and lock 10 is illustrated in FIGS. 6 and 7. In FIG. 6, key 60 has been inserted within lock 10, expander pin 82 surrounding protrusion 42 of lock pin 30. Body 62 of key 60 remains a small distance removed from end cap 14 of lock 10. As cam handle 72 (FIG. 7) is rotated counter-clockwise about pin and spring 74, key plunger 70 and expander pin 82 are drawn away from lock 10. Because outer spring 94 is assembled partly compressed, it exerts a force on expanding sleeve 98 (via spacer 96 and bushing 100) to resist rearward movement when expanding sleeve 98 is contacted by the flared ends of the expander pin 82. Consequently, the fingers of expanding sleeve 98 are forced radially outward until they make contact with bore 28 of plunger 20, thus causing a wedging action which produces a frictional engagement between expanding sleeve 98 and the plunger bore 28.

As cam handle 72 is rotated further, plunger 70, expander pin 82 and expanding sleeve 98 move rearwardly as a unit relative to key body 62. Push rod 80, which is connected to key body 62 via bushing 84, pin 90, sleeve 92, and end cap 68, moves forward in relation to the lock. As key body 62 approaches cap 14 of lock 10, push rod 80 pushes lock pin 30 forward, compressing spring 32, while lock plunger 20 remains stationary due to the frictional engagement between expanding sleeve 98 and bore 28 of plunger 20. Locking balls 16 fall radially into the space vacated by pin sleeve 38, thereby unlocking the lock.

Figure 8:
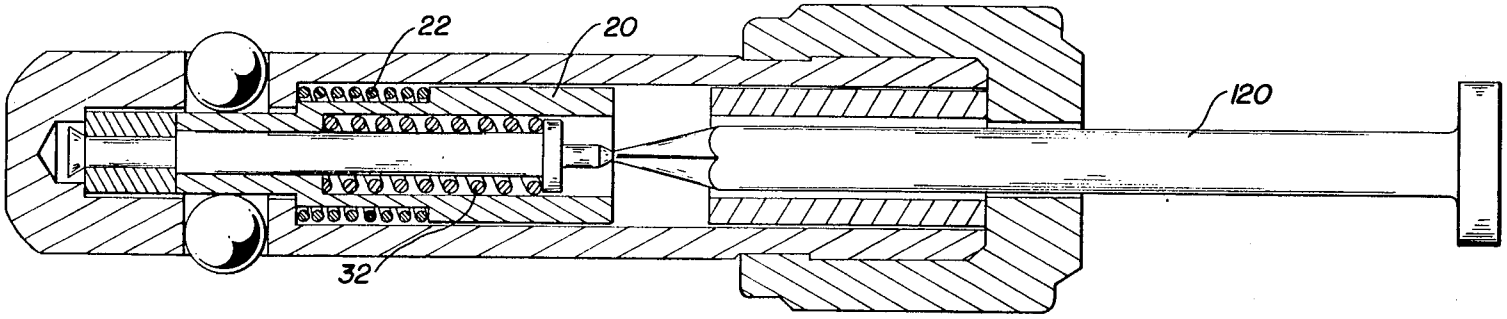
FIG. 8 shows the lock with a nail-type pick inserted into the lock in an unsuccessful attempt to unlock the lock.

Illustrated in FIG. 8 is an unsuccessful attempt to open lock 10 by means of a nail-type pick 120. As pick 120 is pressed forward, lock pin 30 moves forward, but spring 32, whose force is approximately twice that of outer spring 22, causes plunger 20 likewise to move forward in unison with lock pin 30, so that locking balls 16 are maintained in locking position by camming surface 50 of plunger 20 (FIG. 2).

Figure 9:
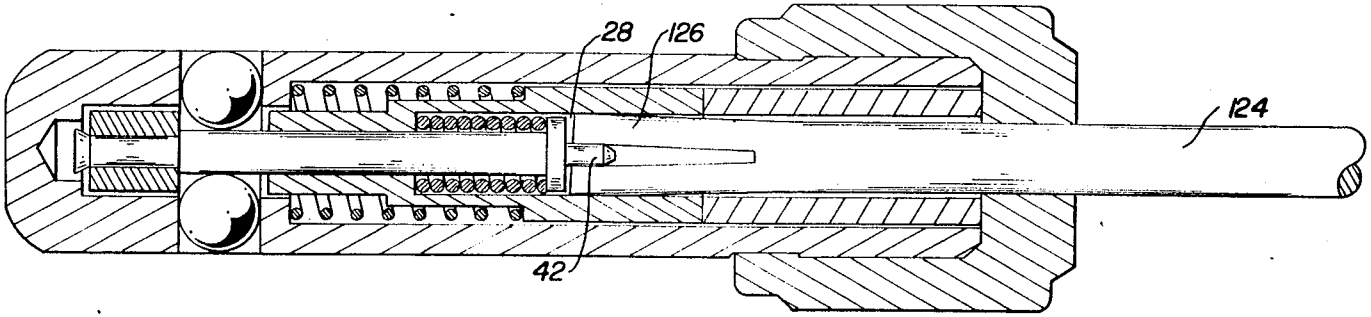
FIG. 9 is an elevation of the pre-load rod inserted into lock to maintain it in its unlocked condition.

For installation purposes, lock 10 may be held open by means of pre-load rod 124 (FIG. 9), which comprises a rod of diameter slightly less than that of bore 28 of plunger 20, and having a flared jaw 126, to wedgingly engage protrusion 42 within the jaw, and bore 28 of plunger 20 by the edges of the jaw. Movement of lock pin 30 is prevented by the frictional engagement of the jaw 126 with the bore 28 of plunger 20. After the lock has been inserted into a support aperture, rod 124 may be removed, causing lock pin 30 to move to its rearward locking position, pin sleeve 38 camming locking balls 16 into their locking positions.

While certain embodiments of the invention have been here described and illustrated, many modifications may be made therein by a person skilled in the art, without departing from the scope of the invention as expressed in the claims. Therefore, the invention is not to be considered limited to the particular forms shown or to the details of construction thereof.

What is claimed is:

1. In a conventional barrel lock and key, the improvement therein comprising:

(a) Said lock having spring-biased plunger means mounted within a barrel for reciprocal movement between a security forward locking position and a normal rearward unlocking position said plunger means having a camming surface adapted to cam at least two locking balls to their outward locking position when said plunger means is moved forwardly against spring pressure to its security locking position, said plunger means being continuously urged rearwardly by spring pressure to its normal rearward unlocking position in which said camming surface is out of engagement with the locking balls thereby permitting the locking balls to move to their inward unlocking position;

(b) said lock having spring-biased pin means mounted coaxially with said plunger means for reciprocal movement between a forward unlocking position and a normal rearward locking position, said pin means having a small diameter portion permitting the locking balls to move to their inward unlocking position when said pin means is moved forwardly against spring pressure to its unlocking position, said pin means having a large diameter camming surface and being continuously urged rearwardly by spring pressure to its normal locking position in which said camming surface cams the locking balls to their outward locking position;

(c) said pin means moving forwardly to its unlocking position when pushed by a nail-type pick, said plunger means moving simultaneously forward, under spring pressure to its security locking position in which said plunger means relatively large diameter camming surface maintains the locking balls in their outward locking position to prevent unauthorized unlocking of the lock by a nail-type pick; and (d) said key having double-acting means for simultaneously maintaining said plunger means in its normal rearward unlocking position and moving said pin means to its forward unlocking position thereby permitting the locking balls to move inwardly to their unlocking position.

2. A double-acting lock and key comprising:

(a) a lock having a hollow barrel, a centrally apertured rear end in said barrel, at least one radially extending locking ball bore located adjacent the front end of said hollow bore, and a locking ball loosely retained in each said locking ball bore, each said locking ball being movable between a radially inward unlocking position and a radially outward locking position;

(b) said lock having a hollow plunger coaxially mounted within said hollow barrel for reciprocating movement between a security forward locking position and a normal rearward unlocking position, said hollow plunger having a forward relatively large diameter security camming surface being sized, shaped, and located so as to cam each said locking ball to its outward locking position when said hollow plunger is moved forwardly to its security locking position, said lock further having a relatively weak outer spring continuously urging said hollow plunger rearwardly in said hollow barrel to its normal unlocking position in which said security camming surface is out of engagement with each said locking ball thereby permitting each said locking ball to move to its inward unlocking position;

(c) said lock having a lock pin coaxially mounted within said hollow plunger for reciprocating movement between a forward unlocking position and a normal rearward locking position, said lock pin having a rearwardly disposed relatively small diameter portion and a forwardly disposed relatively large diameter camming surface, said small diameter portion being sized, shaped and located so as to permit each said locking ball to move to its inward unlocking position when said lock pin is moved to its forward unlocking position, said lock further having a relatively strong inner spring continuously urging said lock pin rearwardly relative to said hollow plunger to its normal locking position in which said large diameter camming surface cams each said locking ball to its outward locking position;

(d) said lock pin moving forwardly to its unlocking position when pushed by a nail-type pick, said relatively strong inner spring simultaneously urging said hollow plunger forwardly to its security locking position, and said plunger relatively large diameter camming surface maintaining each said locking ball in its outward locking position to prevent unauthorized unlocking of said lock by a nail-type pick; and (e) a key having double-acting means for simultaneously maintaining said hollow lock plunger in its normal rearward unlocking position and moving said lock pin to its forward unlocking position, thereby permitting each said locking ball to move inwardly to its unlocking position.

3. The lock and key of claim 2 further including a pre-load rod having a diameter smaller than said centrally apertured barrel rear end, said pre-load rod having a forward end which is sized and shaped to become wedgingly engaged to said hollow plunger while preventing the rearward movement of said lock pin from its forward unlocking position, said pre-load rod being adapted to remain wedgingly engaged within said lock when said lock is inserted through a support aperture, after which said pre-load rod is adapted to being withdrawn from said lock permitting said lock pin to move to its rearward locking position, thereby camming each said locking ball to its locking position.

4. The lock and key of claim 1 wherein said double-acting key means for simultaneously maintaining said hollow lock plunger in its normal rearward unlocking position includes an expanding sleeve.

5. The lock and key of claim 2 wherein said double-acting key means for simultaneously maintaining said hollow lock plunger in its normal rearward unlocking position includes an expanding sleeve.

6. The lock and key of claim 4 wherein said double-acting key means for simultaneously moving said lock pin to its forward unlocking position includes a push rod coaxially mounted within said expanding sleeve for reciprocal movement relative to said sleeve.

7. The lock and key of claim 5 wherein said double-acting key means for simultaneously moving said lock pin to its forward unlocking position includes a push rod coaxially mounted within said expanding sleeve for reciprocal movement relative to said sleeve.

8. The lock and key of claim 2 wherein said relatively weak outer spring is disposed between an inwardly projecting portion of said hollow barrel and said hollow plunger.

9. The lock and key of claim 2 wherein said relatively strong inner spring is disposed between said hollow plunger and said lock pin.

* * * * *